US006679759B2

(12) United States Patent
Kajimoto et al.

(10) Patent No.: US 6,679,759 B2
(45) Date of Patent: Jan. 20, 2004

(54) METHOD OF MANUFACTURING SILICON WAFER

(75) Inventors: Kimihiko Kajimoto, Kashihara (JP); Junzou Wakuda, Kashihara (JP)

(73) Assignee: Sharp Kabushiki Kaisha, Osaka (JP)

( * ) Notice: Subject to any disclaimer, the term of this patent is extended or adjusted under 35 U.S.C. 154(b) by 118 days.

(21) Appl. No.: 09/956,113

(22) Filed: Sep. 20, 2001

(65) Prior Publication Data

US 2002/0036182 A1 Mar. 28, 2002

(30) Foreign Application Priority Data

Sep. 28, 2000 (JP) ..... 2000-296628
Sep. 7, 2001 (JP) ..... 2001-272356

(51) Int. Cl.[7] ..... B24B 1/00
(52) U.S. Cl. ..... 451/41; 451/44; 451/49
(58) Field of Search ..... 451/41, 44, 49, 451/60

(56) References Cited

U.S. PATENT DOCUMENTS 4,084,354 A * 4/1978 Grandia et al. ..... 451/41
5,405,285 A * 4/1995 Hirano et al. ..... 451/1
5,484,326 A * 1/1996 Hirano et al. ..... 451/41

FOREIGN PATENT DOCUMENTS

JP 10-154321 6/1998

* cited by examiner

*Primary Examiner*—M. Rachuba
(74) *Attorney, Agent, or Firm*—Nixon & Vanderhye P.C.

(57) ABSTRACT

A method of manufacturing a silicon wafer including the step of flattening fine roughness existing on a side face of a silicon block or a silicon stack used for manufacturing the silicon wafer.

9 Claims, 6 Drawing Sheets

METHOD OF MANUFACTURING SILICON WAFER

CROSS-REFERENCE TO RELATED APPLICATION

This application is related to Japanese application Nos. 2000-296628 and 2001-272356, filed on Sep. 28, 2000 and Sep. 7, 2001, whose priority is claimed under 35 USC §119, the disclosure of which is incorporated by reference in its entirety.

BACKGROUND OF THE INVENTION

1. Field of the Invention

The present invention relates to a method of manufacturing a silicon wafer. In particular, it relates to a polishing technique for flattening fine roughness existing on a side face of a silicon block or a silicon stack.

2. Description of Related Art

Demand for silicon wafers is increasing year by year in accordance with the spread of solar cells and the like. For example, one solar cell requires about 54 silicon wafers of 5×5 inch square, which are much greater than the number of silicon wafers required in IC and LSI.

The silicon wafer includes polycrystalline and single crystalline silicon wafers, which are manufactured by the following method.

The polycrystalline silicon (polysilicon) wafer is obtained by manufacturing a square polysilicon ingot, cutting the ingot into plural polysilicon blocks 1 with a band saw 20 (FIG. 4) and slicing the polysilicon block 1 (FIG. 5). FIGS. 4 and 5 show a side face 19 of a silicon block, an edge 21 of a silicon block and silicon wafers 46.

The single crystalline silicon wafer is obtained by cutting a cylindrical silicon ingot manufactured by a crystal pulling method (generally 1 m in length) into cylindrical single crystalline silicon blocks in a suitable size (generally 40 to 50 cm in length), grinding the single crystalline silicon block to form a flat portion called an orientation flat and slicing the silicon block.

Where the silicon wafer of high dimensional accuracy is required, grinding is carried out in both cases of processing the polycrystalline and single crystalline silicon blocks. Specifically, the grinding is performed by rotating a polishing wheel 45 such as a circular grindstone containing abrasive grains or a diamond wheel at high speed, pressing the silicon block 1 onto the polishing wheel and moving them relatively to each other. FIG. 6 shows a one-axis stage 7, a direction 11 along which the stage 7 moves, a motor 5 for rotating the polishing wheel, a two-axes stage 6 and a direction 10 along which the stage 6 moves laterally.

In a conventional process of manufacturing the silicon wafer, a process of improving dimensional accuracy of the silicon block or the silicon stack, or a process of erasing unevenness on the surface of the silicon block or the silicon stack has been carried out. However, flattening of the fine surface roughness existing on its side faces has not been conducted.

The thus obtained silicon wafer is subjected to processing of a side face (may be referred to as a periphery face or a circumferential face).

The periphery processing is carried out by grinding the periphery surfaces of the silicon wafers one by one into a desired configuration in the same manner as a method of processing a glass substrate described in Japanese Unexamined Patent Publication No. Hei 10 (1998)-154321, or by chemical polish (etching).

Since the solar cell requires a large number of silicon wafers as compared with IC and LSI, the above-described periphery processing with respect to each of the silicon wafers consumes a lot of time, investment in equipment and labor. This may delay the supply of the silicon wafers behind the demand. Further, the etching requires equipment for liquid waste treatment, which also involves a problem of equipment costs.

However, without the periphery processing, the silicon wafer may be cracked in a later step for manufacturing the solar cell, which reduces a product yield. Accordingly, there has been demanded development of an efficient method for the periphery processing.

SUMMARY OF THE INVENTION

Accordingly, the present invention provides a method of manufacturing a silicon wafer comprising the step of flattening fine roughness existing on a side face of a silicon block or a silicon stack used for manufacturing the silicon wafer.

According to the present invention, the side face of the silicon block or the silicon stack is flattened to such an extent that dimensional accuracy is improved and surface unevenness is eliminated, i.e., the side face is flattened so that it has surface roughness Ry of 8 $\mu$m or less, preferably 6 $\mu$m or less.

These and other objects of the present application will become more readily apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

DESCRIPTION OF THE PREFERRED EMBODIMENTS

An object of the present invention is to provide a polishing technique for flattening fine roughness existing on a side face of a silicon block or a silicon stack in a short period so that the silicon wafer is prevented from cracking and improved in yield.

As a result of eager researches for solving the above problems, it has been found that the fine roughness on the side face of the silicon block or the silicon stack causes the cracking of the silicon wafer and decreases the yield. Then the inventors have found that the cracking is prevented and the yield is improved efficiently by flattening the fine roughness before slicing the silicon block or the silicon stack into the silicon wafer. Thus, the present invention has been achieved.

The "silicon stack" mentioned in the present application signifies a silicon block in the shape of cylinder or quadratic prism in which two or more silicon wafers are stacked. The "side face of the silicon block or the silicon stack" mentioned in the present application signifies a face which will constitute a circumferential surface of the silicon wafer.

Method 1

According to Method 1 of the present invention, a mixture of abrasive grains and a medium is sprayed on a side face of the silicon block or the silicon stack, a polishing member is shifted closer to or contacted with the side face to be polished, and the silicon block or the silicon stack is moved relatively to the polishing member in the presence of the abrasive grains so that the side face of the silicon block or the silicon stack is mechanically and physically polished. Thereby the fine roughness existing on the side face of the silicon block or the silicon stack is flattened.

The abrasive grains may be known abrasive grains, e.g., diamond, GC (Green Carborundum), C (Carborundum), CBN (cubic boron nitride) and the like.

The medium to spray the abrasive grains may be a liquid such as water, alkaline solution, mineral oil, glycols (polyethylene glycol, propylene glycol (PG)) or the like, or a gas such as air or inert gas, e.g., nitrogen, helium, neon, argon or the like. The abrasive grains may be mixed in a ratio of about 0.5–1.5 kg with respect to 1 kg of the liquid medium or about 0.01–2:1 kg with respect to 1 liter of the gaseous medium.

The polishing member may be made of steel, resin, cloth, sponge or the like. More specifically, it may be a steel brush, a resin brush, a sponge wheel or the like. The polishing member may or may not have the abrasive grains on its surface and/or in the inside thereof.

Method 1 will be detailed with reference to FIG. 1.

Figure 1:
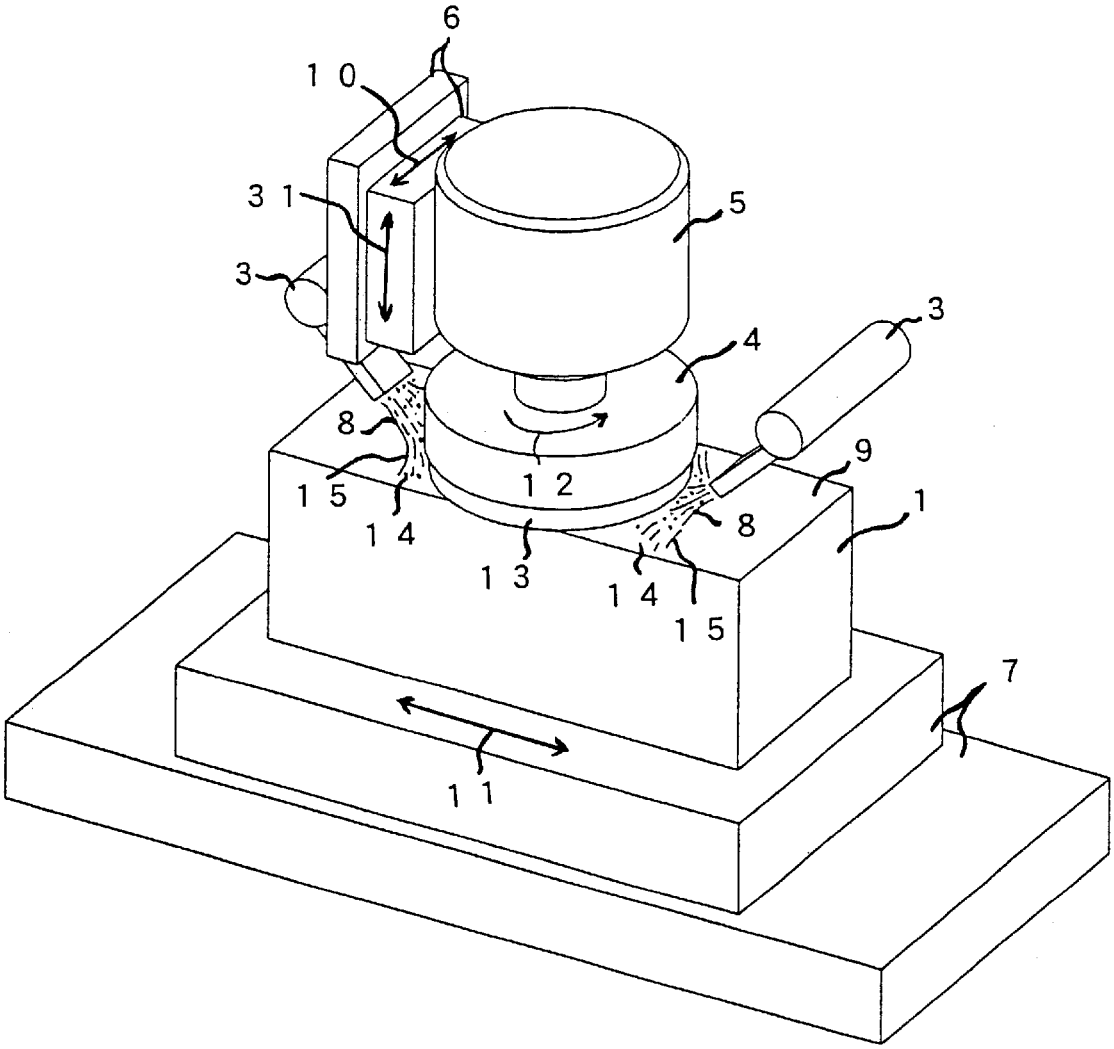
FIG. 1 is a schematic view illustrating a method of manufacturing a silicon wafer according to Method 1 of the present invention.

A polishing member 13 is arranged on a polishing wheel 4 so that it contacts with a side face 9 of a silicon block 1 to be polished, and then rotated at high speed by a motor 5 for rotating the polishing wheel along a direction 12 shown in FIG. 1. At this time, a mixture 8 of abrasive grains 14 and a medium 15 (may be referred to as "slurry" or "dispersed abrasive grains") is sprayed from a nozzle 3. Further, the silicon block 1 is reciprocated by a one-axis stage 7 along a direction 11 shown in FIG. 1. According to the rotational movement of the polishing wheel 4 and the reciprocal movement of the one-axis stage 7, the side face 9 is entirely polished and the fine roughness is removed. The slurry 8 is used to let the abrasive grains 14 into the polishing member 13 of the polishing wheel 4 so that the side face 9 is polished with the abrasive grains 14. Further, the medium 15 in the slurry 8 serves to discharge silicon shavings and unnecessary abrasive grains 14, and cool the side face 9.

FIG. 1 shows a two-axis stage 6 capable of moving in a lateral direction 10 and a vertical direction 31, which is used to shift the polishing wheel 4.

Method 2

According to Method 2 of the present invention, a medium is sprayed on a side face of the silicon block or the silicon stack, a polishing member having abrasive grains on its surface and/or in the inside thereof is shifted closer to or contacted with the side face to be polished, and the silicon block or the silicon stack are moved relatively to the polishing member so that the side face of the silicon block or the silicon stack is mechanically and physically polished. Thereby the fine roughness existing on the side face of the silicon block or the silicon stack is flattened.

The medium to spray the abrasive grains may be the above-described liquid or gas. The liquid or the gas may not contain the abrasive grains.

The polishing member having the abrasive grains on its surface and/or in the inside thereof may be made of steel, resin, cloth, sponge or the like having, on its surface and/or in the inside thereof, abrasive grains such as diamond, GC (Green Carborundum), C (Carborundum), (CBN (cubic boron nitride) or the like. More particularly, the polishing member may be a steel brush, a resin brush, a sponge wheel or the like.

The liquid or the gas to be sprayed serves to remove, from the surface of the silicon block, silicon shavings and the abrasive grains fallen from the surface and/or the inside of the polishing member. Where the liquid or the gas containing no abrasive grains is used, the liquid or the gas is easily recycled and the abrasive grains and the silicon shavings are easily separated.

Figure 2:
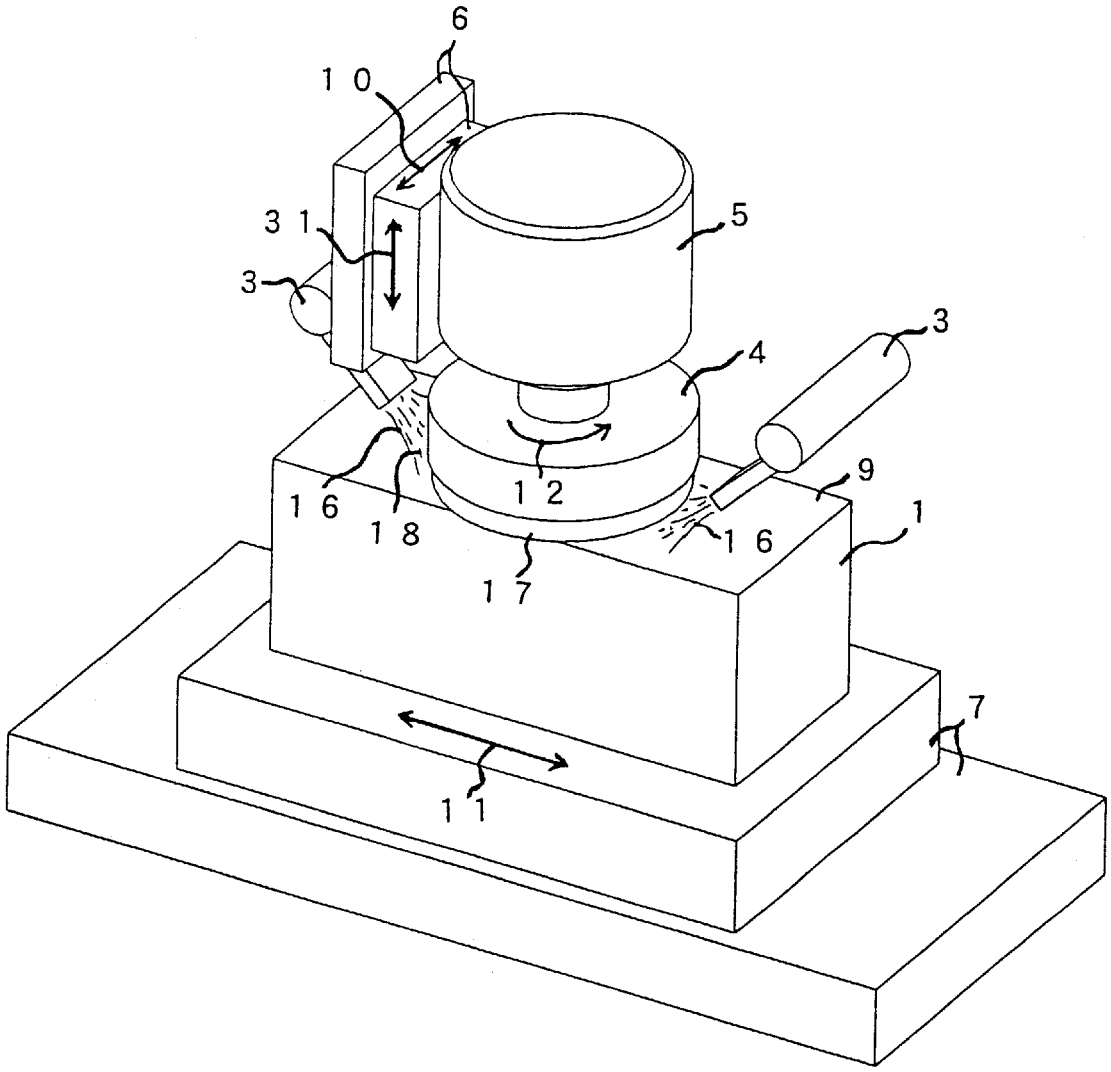
FIG. 2 is a schematic view illustrating a method of manufacturing a silicon wafer according to Method 2 of the present invention.
Figure 3:
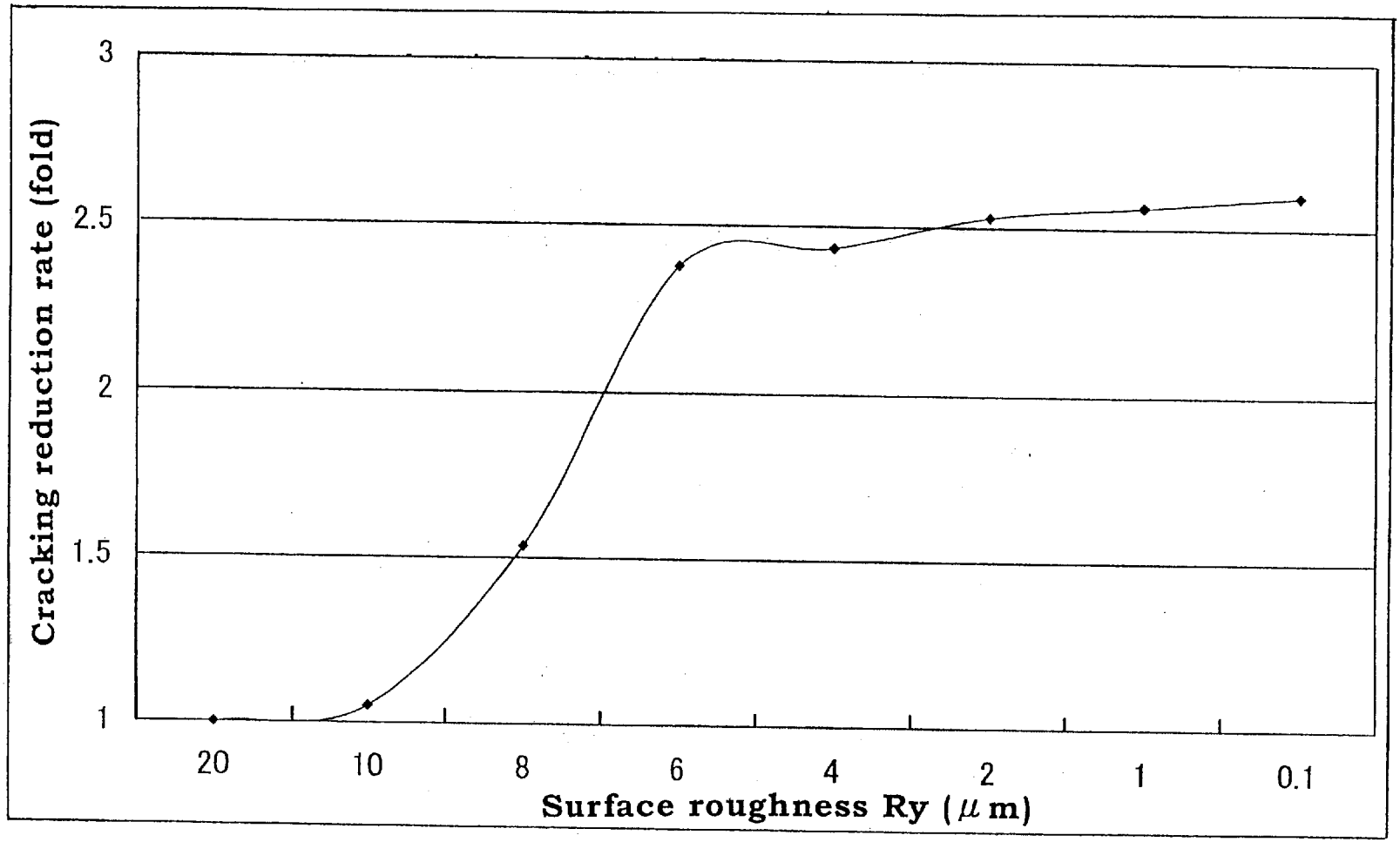
FIG. 3 is a graph illustrating a relationship between surface roughness of a circumferential surface of a silicon wafer and cracking reduction ratio of a solar cell from the silicon wafer.

Method 2 will be detailed with reference to FIG. 2.

The difference from Method 1 is that the polishing member 17 having the abrasive grains on its surface or in the inside thereof is arranged on the polishing wheel 4 so that it contacts with the side face 9 of the silicon block 1 to be polished, and then a polishing liquid or polishing gas 16 comprising a medium 18 is sprayed. That is, the side face 9 of the silicon block 1 is polished by the abrasive grains 14 (not shown) of the polishing member 17. The polishing liquid or polishing gas 16 is sprayed onto the side face 9 of the silicon block 1 to be polished in order to remove the silicon shavings, unnecessary abrasive grains (grain scraps) and waste generated during the polishing, and to cool the side face 9. Other components than the above-mentioned ones are indicated by the same reference numbers shown in FIG. 1.

This method prevents contamination of the side face by the silicon shavings, grain scraps and waste, and sticking of such unnecessary wastes to the side face after polishing. Accordingly, reduction of processing quality is prevented. Where the polishing liquid is used, the removal of the shavings and waste can be easily carried out by using a filter or the like, which eliminates the need to exchange the liquid in every polishing process.

The side face of the silicon block or the silicon stack flattened by the above method preferably shows surface roughness Ry of 8 $\mu$m or less, more preferably 6 $\mu$m or less. Where the thus obtained silicon block or the silicon stack having the surface roughness of 8 $\mu$m is sliced into silicon wafers for manufacturing a solar cell, the yield of the solar cells increases because damage of the silicon wafers is small.

In the method of manufacturing the silicon wafer according to the present invention, the section of the silicon block or the silicon stack, i.e., the shape of the silicon wafer in a front view, is not particularly limited. However, it is preferred that the section comprises four main lines and the lines form angle of about 90° with adjacent lines, respectively. That is, the section is preferably a rectangle or almost rectangle constituted of sides parallel to opposite sides, respectively. The silicon block or the silicon stack having such a section is preferred because two opposite side faces can be polished and flattened simultaneously. This allows high-speed processing. Further, where the silicon block or the silicon stack has a rectangular or almost rectangular section, accuracy in positioning the polishing wheel and the silicon block or the silicon stack is not required, which eliminates the need of expensive equipment.

Alternatively, the rectangular or almost rectangular section of the silicon block or the silicon stack may be formed of four lines connected to adjacent lines via another line or curve, respectively. That is, the section may have rounded corners each having a curve or an arc.

EXAMPLES

Hereinafter, the present invention will be further detailed by way of examples, but the invention is not limited thereto.

Example 1

Cutting a Silicon Block

Figure 4:
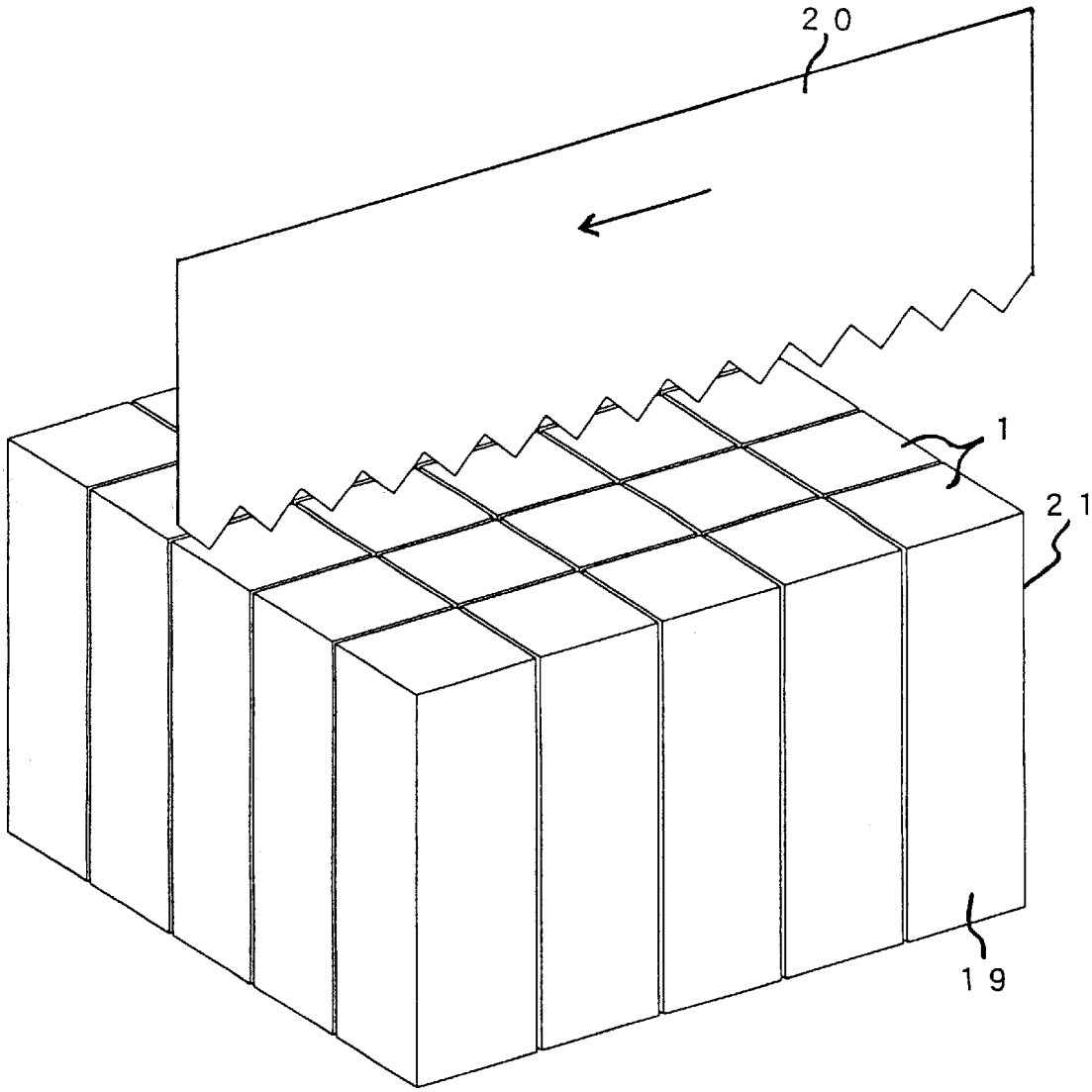
FIG. 4 is a schematic view illustrating a method of cutting a silicon ingot into silicon blocks.

As shown in FIG. 4, a silicon block 1 was cut from a silicon ingot using a band saw 20. FIG. 4 shows a side face 19 of the silicon block and an edge 21 of the silicon block.

Four side faces 19 of the silicon block 1 were flattened by the method of the present invention to reduce defective wafers cracked in a later step and thus improve yield of the silicon wafer.

Example 2

Method 1

The silicon block 1 of 125×125×250 mm obtained in Example 1 was polished by Method 1 to confirm the effect of the invention. A sponge wheel and a mixture of GC abrasive grains (#800) with polish oil were used as the polishing member 13 and the slurry 8, respectively.

As a result, four side faces 9 were polished in 16 minutes. Surface roughness Ry of the side faces was reduced from 20 μm to 5.8 μm by the polishing.

Example 3

Method 1, Using Resin Brush

The silicon block 1 of 125×125×250 mm obtained in Example 1 was polished by Method 1 to confirm the effect of the invention. As the polishing member 13, a wheel (240 mm in diameter) provided with nylon resin hairs (0.5 mm in diameter, 20 mm in length) densely fixed with an epoxy adhesive on a bottom region of 160–240 mm diameter was used. As the slurry 8, a mixture of GC abrasive grains (#800) and polish oil (weight ratio 1:1.28) was used.

The polishing member 13 was pressed on the surface of the silicon block 1 to such a degree that the distal ends of the nylon resin hairs reach 1.5 mm below a position where the distal ends contact the surface of the silicon block 1. Then, the polishing member was rotated at 1800 rpm.

After the polishing member 13 contacted the surface of the silicon block l, the silicon block 1 was moved along a lengthwise direction of the silicon block, which is orthogonal to a rotation axis of the polishing member 13. The silicon block 1 was moved at 0.6 mm/sec.

From the circumference of the polishing member 13, the slurry 8 of 150 l/min was sprayed onto the side face 9 of the silicon block 1 to be polished.

As a result, four side faces 9 were polished in 12 minutes. The surface roughness Ry was reduced from 12 μm to 2.8 μm by the polishing. Cracking reduction ratio was 2.5 fold (ratio of cracked defective wafers was reduced by 60%, i.e., reduction of yield due to wafer cracking was decreased by 60%).

The cracking reduction ratio signifies a value obtained by dividing a ratio ($X_A$) of cracked silicon wafers to silicon wafers having reference surface roughness Ry=A μm used for the manufacture of a solar cell panel by a ratio ($X_B$) of cracked silicon wafers to silicon wafers having surface roughness of Ry=B μm used for the manufacture of a solar cell panel (provided that A>B).

$$\text{(Cracking reduction ratio)}_{Ry=B}=(X_A/X_B)$$

For example, provided that $X_{20}=1$ and $X_8=0.66$, the cracking reduction ratio is calculated as follows:

$$\text{(Cracking reduction ratio)}_{Ry=B}=(X_{20}/X_8)=1/0.66=1.52$$

Example 4

Method 2

The silicon block 1 of 125×125×250 mm obtained in Example 1 was polished by Method 2 to confirm the effect of the invention. A sponge wheel provided with diamond grains (#800) was used as a polishing member 17 and polish oil was used as a polishing liquid 16 containing no abrasive grains.

As a result, four side faces 9 of the silicon block were polished in 14 minutes. The surface roughness Ry was reduced from 12 μm to 5.8 μm by the polishing.

Example 5

Method 2, Using Resin Brush

The silicon block 1 of 125×125×250 mm obtained in Example 1 was polished by Method 2 to confirm the effect of the invention. As the polishing member 17, a wheel (220 mm in diameter) provided with nylon resin hairs (0.4 mm in diameter, 15 mm in length) containing diamond grains (#320) densely fixed with an epoxy adhesive on a bottom region of 160–240 mm diameter was used. The slurry 8 used in Example 3 was used as the polishing liquid 16.

The polishing member 17 was pressed on the surface of the silicon block 1 to such a degree that the distal ends of the nylon resin hairs reach 1.5 mm below a position where the distal contact the surface of the silicon block. Then, the polishing member was rotated at 600 rpm.

After the polishing member 17 contacted the surface of the silicon block 1, the silicon block 1 was moved along a lengthwise direction of the silicon block 1 which is orthogonal to a rotation axis of the polishing member 17. The silicon block 1 was moved at 5 mm/sec.

From the circumference of the polishing member 17, the slurry 8 of 150 l/min was sprayed onto the side face 9 of the silicon block 1 to be polished.

As a result, four side faces of the silicon block were polished in 4 minutes. The surface roughness Ry was reduced from 12 μm to 5 μm by the polishing. The cracking reduction ratio was 2 fold (ratio of cracked defective wafers was reduced by 50%, i.e., reduction of yield due to wafer cracking was decreased by 50%).

Example 6

Method 2, Using Resin Brush

The silicon block 1 polished in Example 5 was further polished for 4 minutes to confirm the effect of the invention in the same manner as in Example 5, except that a wheel (220 mm in diameter) provided with nylon resin hairs (0.4 mm in diameter, 15 mm in length) containing diamond grains (#800) and fixed densely with an epoxy adhesive on a bottom region of 160–220 mm diameter was used as the polishing member 17.

As a result, the surface roughness Ry was reduced from 12 μm to 1 μm by the polishing. The cracking reduction ratio was 2.5 fold (ratio of cracked defective wafers was reduced by 60%, i.e., reduction of yield due to wafer cracking was decreased by 60%).

Example 7

Surface Roughness and Cracking Reduction Ratio

A silicon block polished by the method of the present invention was sliced into silicon wafers by a known method. With the thus obtained silicon wafers, a solar cell panel was manufactured and the cracking reduction ratio in the solar cell panel was obtained with respect to that of a solar cell panel manufactured by a conventional method. Surface roughness Ry of 20 μm was determined as a reference for the cracking reduction ratio.

Sets of 10,000 silicon wafers having the surface roughness Ry of 0.1, 1, 2, 4, 6, 8, 10, and 20 μm, respectively, were manufactured and solar cell modules were manufactured through a solar cell module manufacture line. FIG. 4 shows the results. In FIG. 4, the surface roughness Ry (μm) is plotted in a vertical axis and the cracking reduction ratio (fold) of the solar cell panel is plotted in a horizontal axis.

In the range of Ry=6–8 μm, reduction of cracked defective wafers of 1.5 or more was observed. That is, the surface roughness Ry of 8 μm or less is effective in reduction of cracked defective wafers.

Example 8

As shown in FIG. 4, a rectangular polysilicon ingot (250 mm in length) was cut into silicon blocks 1 in the form of quadratic prism (125×125 mm) using a band saw 20. If the band saw has enough accuracy, it is not necessary to grind the surface of the silicon block. Edges 21 of the silicon block 1 were cut off and rounded to complete the silicon block.

Figure 5:
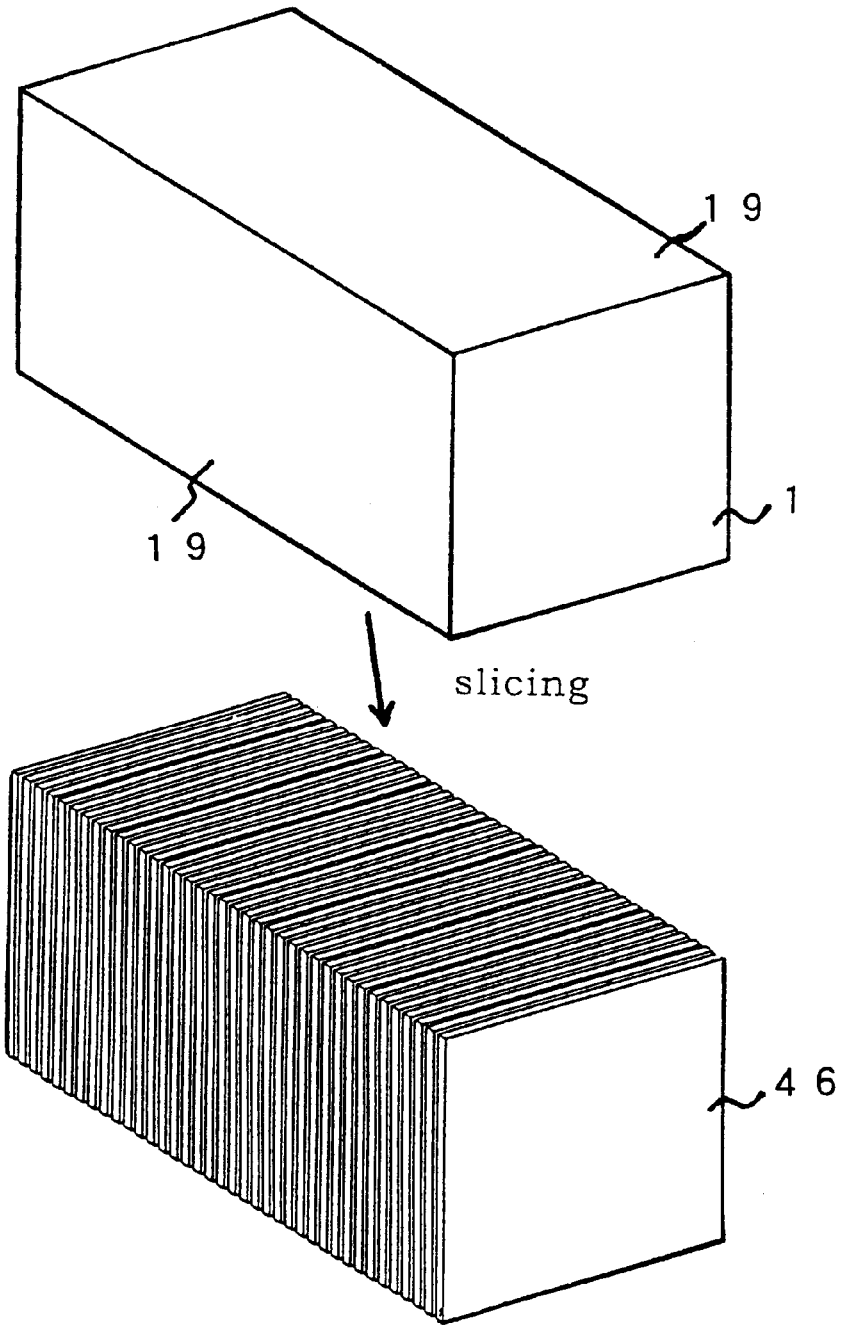
FIG. 5 is a schematic view illustrating a method of slicing a silicon block into silicon wafers.
Figure 6:
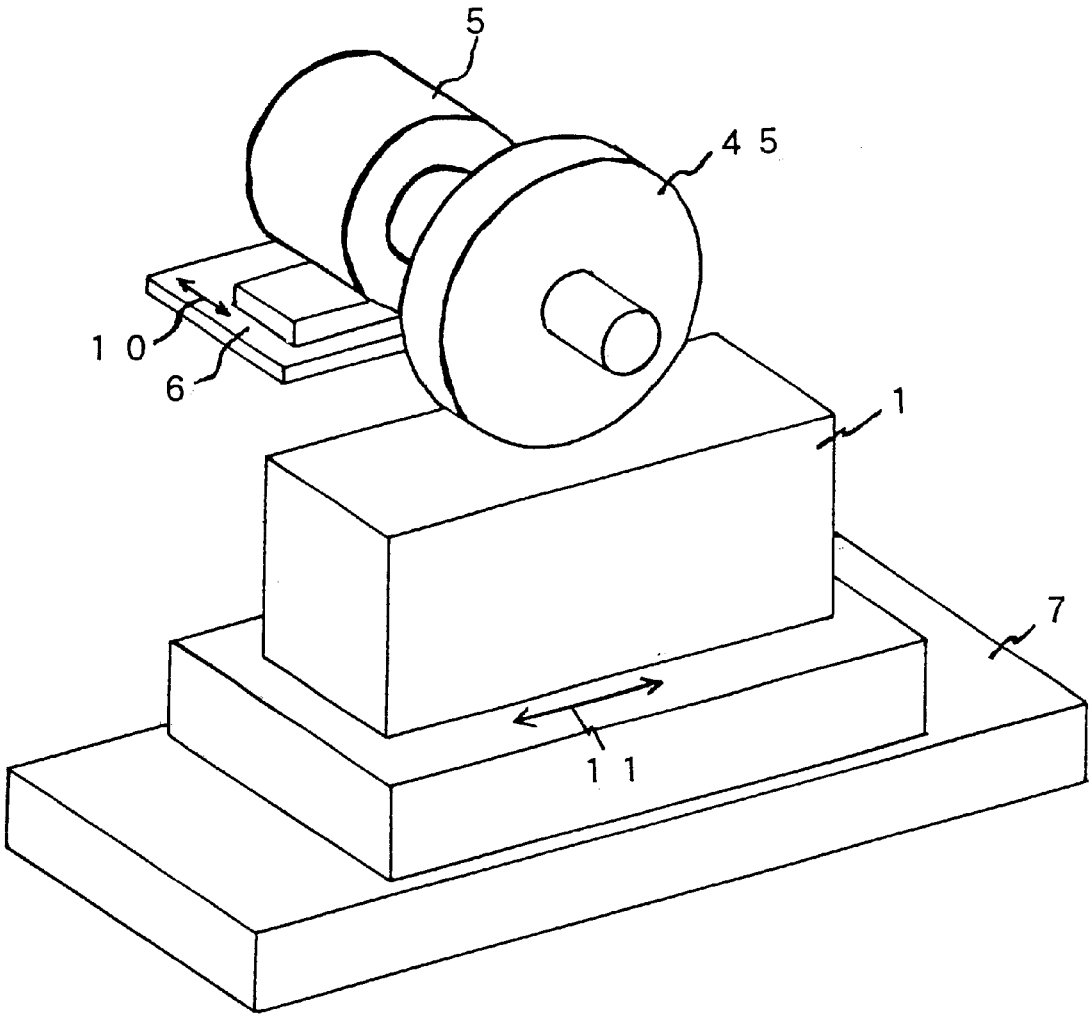
FIG. 6 is a schematic view illustrating a conventional process of grinding a silicon block.

Surfaces of the thus obtained silicon block that would serve as circumferential surfaces of the silicon wafer were polished mechanically and physically by the method of the invention. Then, as shown in FIG. 5, the silicon block 1 was sliced with a wire saw (not shown) to obtain about 470 silicon wafers 46.

The present invention provides a polishing technique for flattening the fine roughness on the side face of the silicon block or the silicon stack in a short period and allows reduction of cracked defective the silicon wafer and improvement in yield of the silicon wafer.

What is claimed is:

1. A method of manufacturing at least one silicon wafer, the method comprising:

flattening fine roughness existing on a side face of a silicon block or a silicon stack used for manufacturing the silicon wafer, wherein said flattening comprises polishing said side face of the silicon block or silicon stack to reduce surface roughness thereof so that after said polishing the side face has a surface roughness of 8 μm or less; and after said polishing, slicing the silicon block or silicon stack into a plurality of wafers.

2. A method according to claim 1, wherein the step of flattening comprises spraying a mixture of abrasive grains and a medium on the side face of the silicon block or the silicon stack, shifting closer or contacting a polishing member to or with the side face to be polished, and moving the silicon block or the silicon stack relatively to the polishing member in the presence of the abrasive grains so that the side face of the silicon block or the silicon stack is mechanically and physically polished.

3. A method according to claim 1, wherein the step of flattening comprises spraying a medium on the side face of the silicon block or the silicon stack, shifting closer or contacting a polishing member having abrasive grains on its surface and/or in the inside thereof to or with the side face to be polished, and moving the silicon block or the silicon stack relatively to the polishing member so that the side face of the silicon block or the silicon stack is mechanically and physically polished.

4. A method according to claim 2 or 3, wherein the polishing is carried out while spraying the mixture of the abrasive grains and the medium or the medium solely.

5. A method according to claim 1, wherein the polishing reduces the surface roughness of the side face to 6 μm or less.

6. A method according to claim 1, wherein a section of the silicon block or the silicon stack is constructed of four main lines, the lines forming an angle of about 90° with adjacent lines, respectively.

7. A method of making a plurality of wafers comprising silicon, the method comprising:

providing at least one block comprising silicon, said block having first and second ends and at least one side face;

polishing at least said side face of the block comprising silicon in order to reduce a surface roughness of the side face of the block to a value(s) of 8 μm or less; and after said polishing, slicing the block comprising silicon into a plurality of wafers comprising silicon.

8. The method of claim 7, wherein said block is in the shape of a cylinder or a quadratic prism.

9. The method of claim 7, wherein said polishing reduces the surface roughness of the side face of the block to a value(s) of 6 μm or less.

* * * * *